US006475612B1

(12) United States Patent
Knight et al.

(10) Patent No.: US 6,475,612 B1
(45) **Date of Patent: *Nov. 5, 2002**

(54) PROCESS FOR APPLYING A TOPCOAT TO A POROUS BASECOAT

(75) Inventors: Douglas E. Knight, San Diego, CA (US); Yi-Hua Tsao, San Diego, CA (US); Eric L. Burch, San Diego, CA (US); Yubai Bi, San Diego, CA (US); Bor-Jiunn Niu, San Diego, CA (US); Peter C. Zahrobsky, San Diego, CA (US); Barbara A. Kumpf, San Diego, CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/491,642

(22) Filed: Jan. 27, 2000

(51) Int. Cl.[7] ..... B05D 1/36; B05D 3/10

(52) U.S. Cl. ..... 428/304.4; 427/322; 427/337; 427/340; 427/407.1; 427/411; 427/412.2

(58) Field of Search ..... 427/322, 337, 427/340, 407.1, 411, 412.2; 428/304.4

(56) References Cited

U.S. PATENT DOCUMENTS

| | | | | |
|---|---|---|---|---|
| 5,275,867 A | | 1/1994 | Misuda et al. | 428/195 |
| 5,576,088 A | * | 11/1996 | Ogawa et al. | 428/327 |
| 5,605,750 A | | 2/1997 | Romano et al. | 428/304.4 |
| 5,989,378 A | * | 11/1999 | Liu et al. | 156/241 |
| 6,187,430 B1 | * | 2/2001 | Mukoyoshi et al. | 428/331 |

FOREIGN PATENT DOCUMENTS

| | | | | |
|---|---|---|---|---|
| EP | 0878322 A2 | | 11/1998 | B41M/5/00 |
| EP | 0878322 A3 | | 11/1998 | B41M/5/00 |
| EP | 878322 A2 | * | 11/1998 | |
| JP | 8300804 | | 11/1996 | B41M/5/00 |

* cited by examiner

*Primary Examiner*—Michael Barr

(57) ABSTRACT

A process is provided that allows the production of multilayer coatings in which one or more topcoats can be applied to a porous basecoat to produce a uniform and defect-free coating layer. Specifically, a process is provided in which a liquid is applied to the basecoat prior to topcoating such that the air in the basecoat is removed prior to topcoating. This process can occur in-line with a simple apparatus described herein. An added benefit of this method is that it also allows the possibility of adding functionality or performing chemistry to a basecoat after the basecoat is dried and before the topcoat is applied in a single process. For example, the wetting fluid may contain, but is not limited to, surfactants, pH modifiers, polymers, crosslinkers, pigments, and/or dye stabilizers. Advantages over what has been done before include the use of re-wetting process that allows a topcoat to be applied to a porous basecoat that is coated on a non-porous substrate such that bubbles are not formed in the topcoat. In addition, there is added flexibility of incorporating functionality or chemistry in the re-wetting process. Finally, the process is simple to implement and is compatible with many general coating methods, such as slot-die coating, rod coating, blade coating, gravure coating, knife-over-roll coating, or the like.

22 Claims, 1 Drawing Sheet

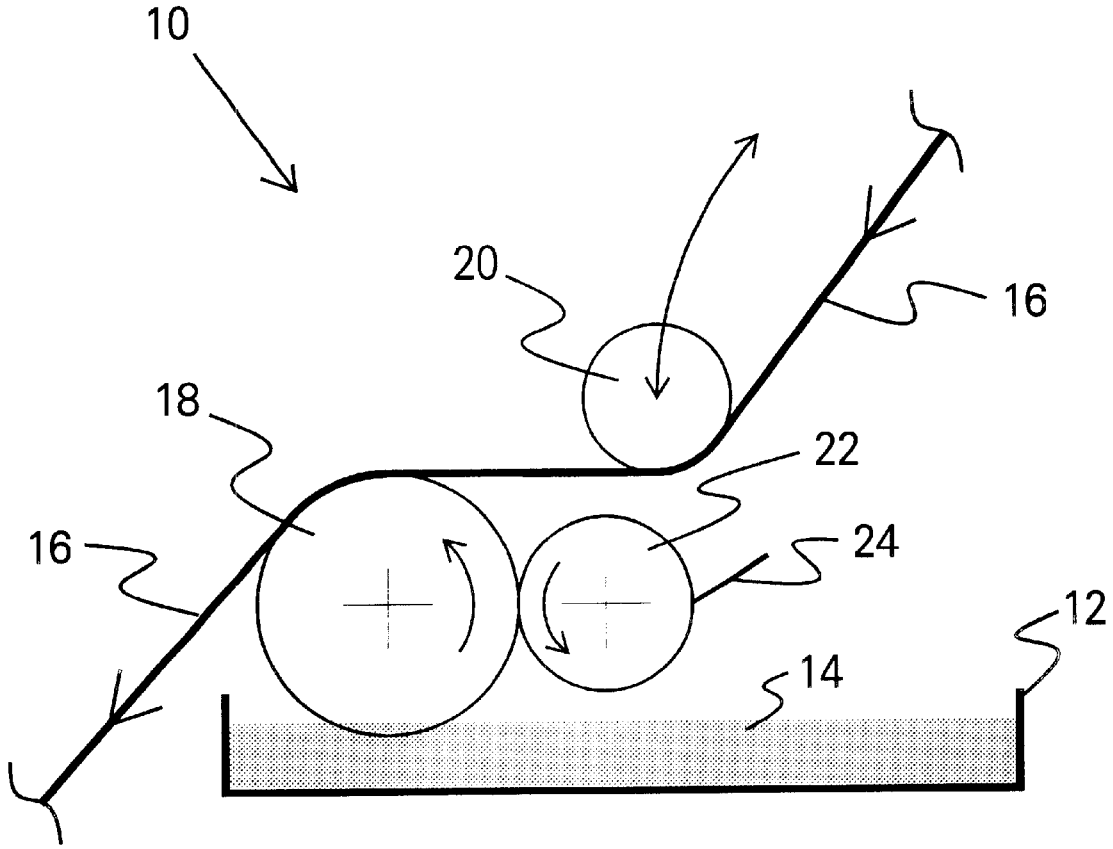
10
20
16
18
22
16
24
12
14

PROCESS FOR APPLYING A TOPCOAT TO A POROUS BASECOAT

TECHNICAL FIELD

The present invention relates generally to ink-jet printing, and, more particularly, to improving the properties of an ink-receiving layer applied to a non-absorbent substrate.

BACKGROUND ART

Ink-jet receiving layers need to absorb the ink vehicle delivered during the printing process. When the ink-receiving layer is applied to non-absorbent substrate, the substrate provides no absorption capacity and as a result, the ink-receiving layer must be the sole absorbing material. To increase the absorbing capacity of the coating, an absorbent precoat has been described in the prior art that serves to increase the capacity of the coating, much as a substrate functions in paper-based ink-jet media.

A topcoat is applied to control surface properties such as gloss, tackiness, surface energy, and durability, as well as to function in concert with the adsorbent precoat. In addition, the topcoat must be free of defects that would contribute to perceived irregularities or non-uniformities in the coating.

U.S. Pat. No. 5,275,867 describes a two-layer coating and a coating process where a topcoat is laminated on the precoat. U.S. Pat. No. 5,605,750 describes a three-layer coating and a coating process where the topcoats are applied to the precoat by coating both fluids before drying in a multi-slot hopper or a slide hopper. U.S. Pat. No. 5,576,088 describes a two layer coating and a coating process where a topcoat is cast coated on a precoat. All these examples describe a process that involves specialized equipment and coatings engineered to be compatible with the processes. In addition, production efficiencies may be lower.

An on-going problem in the application of a topcoat with basic coating equipment such as mayer rod and slot die coaters is the formation of bubbles in the topcoat when it is coated on a porous basecoat that has been applied to a non-porous substrate. These bubbles are formed when the air voids in the pores of the precoat are filled with fluid from the topcoat application process which results in the air being forced to surface of the precoat where they coalesce into bubbles in a still fluid topcoat. These bubbles can then form defects in the topcoat as that coating is dried. Another challenge when developing coating fluids and chemistries is avoiding problems associated with incompatible chemistries that result in solution gelling or phase separation in the dried coatings.

Thus, what is needed is a process that avoids the problems of the prior art and provides a uniform and defect-free topcoat layer, and thus allows the incorporation of incompatible chemistries into the coating.

DISCLOSURE OF INVENTION

The present inventors describe herein a process that allows the production of multi-layer coatings in which one or more topcoats can be applied to a porous basecoat to produce a uniform and defect-free coating layer. Specifically, a process is provided in which a liquid is applied to the basecoat prior to topcoating such that the air in the basecoat is removed prior to topcoating. This process can occur in-line with a simple apparatus described herein. An added benefit of this method is that it also allows the possibility of adding functionality or performing chemistry to the coatings after the basecoat is dried and before the topcoat is applied in a single process. For example, the wetting liquid may contain, but is not limited to, surfactants, pH modifiers, polymers, crosslinkers, pigments, and/or dye stabilizers.

Advantages of the invention over what has been done before include the use of rewetting process that allows a topcoat to be applied to a porous basecoat that is coated on a non-porous, or non-permeable, substrate such that bubbles are not formed in the topcoat. This allows the production of defect-free coatings. In addition, there is added flexibility of incorporating functionality or chemistry in the re-wetting process. Finally, the process of the present invention is simple to implement and is compatible with many general coating methods, such as slot-die coating, rod coating, blade coating, gravure coating, knife-over-roll coating, or the like.

An additional benefit of the above technique is that chemicals may be added to a coating which would otherwise be incompatible in the coating solution itself or the dried coating.

A still further benefit of the above technique is that two coating layers may be applied where incompatibilities may present difficulties in a wet-on-wet coating application technique.

BRIEF DESCRIPTION OF THE DRAWINGS

The sole FIGURE illustrates apparatus useful in the practice of the present invention.

BEST MODES FOR CARRYING OUT THE INVENTION

Reference is made now in detail to a specific embodiment of the present invention, which illustrates the best mode presently contemplated by the inventors for practicing the invention. Alternative embodiments are also briefly described as applicable.

The basecoat and the topcoat each comprise one or more pigments and one or more binders, which are polymeric compounds soluble or dispersible in the solvent in which the basecoat and topcoat are applied to the substrate. Examples of pigments include silica and alumina and its various hydrates, titania, carbonates (e.g., calcium carbonate, magnesium carbonate), glass beads, and organic pigments (e.g., plastic or polymer pigments such as cross-linked SBR latexes, micronized polyethylene or polypropylene wax, acrylic beads, and methacrylic beads). The pigment may be the same in both the basecoat and topcoat or different.

The binder is a polymeric matrix which serves, among other things, to hold the pigment(s) in place. The binder can be water-soluble or water-dispersible. Examples of water-soluble binders include polyvinyl alcohol and its derivatives, polyvinyl pyrrolidone/polyvinyl acetate copolymer, cellulose derivatives, polyamides, and polyethylene oxide. Examples of water-dispersed binders include styrene-butadiene latexes, polyacrylics, polyurethanes, and the like. The binder may be the same in both the basecoat and topcoat or different.

The basecoat and topcoat are separately applied in solution to the substrate and allowed to dry.

The substrate comprises non-permeable (non-air permeable) material, such as a film-based material, e.g., Mylar, or a resin-coated papers (e.g., photobase paper).

In accordance with the present invention, pores in the basecoat are saturated, or nearly saturated, with a liquid, also called a re-wetting solution herein, before the topcoat solution is applied. Preferably, the pores in the basecoat are saturated with liquid before the topcoat solution is applied. Also preferably, a solvent that is compatible with the solvent in the topcoating is believed to give the best adhesion between coating layers.

The liquid may comprise one or more solvents. The liquid may be heated or chemically modified to increase the penetration rate in the precoat.

If heated, the liquid is heated to any temperature below its boiling point (or the minimum boiling point if two or more solvents are used).

By "chemically modified" is meant the addition of one or more surfactants, adhesion promoters, pH modifiers, polymers, crosslinkers, pigments, and/or dye stabilizers to the liquid. The chemically modified re-wet solution thus serves to modify the properties of the basecoat, topcoat, the coating process, or the performance of the coatings as it relates to its use as a printing media. Any of the usual surfactants, pH modifiers, and/or crosslinkers may be used in the practice of the present invention. For example, where the binder in the basecoat is polyvinyl alcohol, a suitable crosslinker added to the liquid is a borate glyoxyl. This process is especially useful for chemistries that are not compatible with the coating fluids or process.

It is also preferred that excess fluid on the surface of the basecoat be removed before topcoating. This can be accomplished by a nip, doctoring blade, or the like.

The sole FIGURE shows apparatus 10 useful in the process of the present invention. The apparatus 10, which is a conventional coater, comprises a container 12 for containing a re-wetting solution 14. A web 16 comprises the non-absorbent substrate and a porous basecoat thereon and the solution 14 is introduced onto the surface of the porous basecoat by means of an applicator roller 18. A hold-down roller 20 urges the web 16 against the top of the applicator roller 18. The applicator roller 18 applies the liquid 14 to the web 16. The liquid 14 is metered onto the applicator roller 18 by a metering roller 22, provided with a doctor 24, or other suitable means.

In an alternate embodiment, the excess re-wet solution may be doctored off of the web.

In another alternative embodiment, the re-wet solution can be metered by a pump directly onto the moving web 16, thus eliminating the need for doctoring.

The uptake of the liquid 14 depends on the speed of the web 16. It is desired to move the web 16 as fast as possible to maximize the coating efficiency.

The dwell time of the re-wet fluid is defined as the time interval between application of the re-wet fluid and application of the coating. The dwell time thus determines the length of time available for the re-wet solution to penetrate into the basecoat. The dwell time can be modified by the web speed and web distance between the re-wet station and the coating station. The length of time required to obtain adequate saturation of the basecoat is determined by the design of the re-wet station, the basecoat properties, the topcoat properties, and the re-wet fluid properties. For this process to be effective, all of these parameters need to be accounted for when designing the coating process.

The present invention provides a number of advantages. First, the invention permits applying a topcoat solution on porous basecoats formed on non-porous substrates. Second, the invention permits incorporation of materials for either the basecoat or the topcoat that would otherwise be incompatible with each other. Third, the invention allows incompatible liquids to be coated in multilayer systems.

EXAMPLES

Comparative Example 1

Preparation of Coating—Base Case, No Re-Wet, Bubbles

A coating was prepared on either a film-based substrate (Mylar) or a resincoated paper substrate (photobase paper) that contained the following components:

| Chemical | Manufacturer | Grade | Parts by weight |
|---|---|---|---|
| | | Basecoat | |
| silica | Grace Davison | 0.2 $\mu$m porous | 100 |
| polyvinyl alcohol | Air Products | Airvol 350 | 26 |
| acrylic | Dow | XUR 1540 2494-6 | 5 |
| water | | | (solids at 17 wt %) |
| | | Topcoat | |
| alumina | Condea Vista | Dispal 14N4-25 | 100 |
| polyvinyl pyrrolidone/polyvinyl acetate | BASF | Luviquat FC370 | 2 |
| polyvinyl alcohol | Nippon | Gohesfeimer Z200 | 12 |
| polyethylene glycol (surfactant) | Union Carbide | Carbowax 8000 | 7 |
| water | | | (solids at 22 wt %) |

The basecoat was mixed in water by adding the components to the water to a level of 17 wt %. The basecoat was then coated on a resin coated substrate with a mayer rod. The coating was dried at 100° C. for 5 minutes to yield a coating with 20 $gm^2$ coatweight and 0.9 $cm^3/g$ porosity. The topcoat materials were also mixed together in water by adding the components to the water, this time to a level of 22 wt %. The topcoat was then de-aerated overnight to remove retained air, and then coated.

After coating the topcoat, bubbles appeared almost immediately. After drying as above, these bubbles produce visible coating defects where craters had formed.

Example 1

Base Case, With Re-Wet, No Bubbles

The topcoat was applied as above except that the topcoat was applied after the basecoat was wetted with excess water (the re-wetting solution) and then the surface was dried with a towel. In this instance, water alone was used; no chemical modifiers were used. The result after drying was a defect-free coating.

Comparative Example 2

Gelling—Base Case, Cascade Coating, Gelling Process Incompatibility

Comparative Example 2 and Example 2 demonstrate the occurrence of gelling and the alleviation of gelling, respectively.

The topcoat and the basecoat had the following formulations, where DI-$H_2O$ means deionized water:

| Chemicals | Manufacturer | Grade | Parts by Weight |
|---|---|---|---|
| | | Topcoat: | |
| alumina | Condea Vista | Dispal 14N4-25 | 36 |
| polyamide | Georgia-Pacific | Amres 8855 | 2.5 |
| glycerol | Aldrich | | 1.2 |
| DI-$H_2O$ | | | 120 |

-continued

| Chemicals | Manufacturer | Grade | Parts by Weight |
|---|---|---|---|
| | | Basecoat: | |
| silica | Grace Davison | 0.2 μm porous | 100 |
| polyvinyl alcohol | Air Products | Airvol 350 | 26 |
| styrene-butadiene latex | Dow | XUR 1540 2494-6 | 5 |

In both instances, the non-water components were added to water. The basecoat had a solids concentration of 14.2% and a pH of 8.5, while the topcoat had a solids concentration of 15% and apH of 4.1.

Cascade coating was employed, with one wet coating placed on top of another wet coating. Here, it was found that the two solutions gelled on the die even before the fluids hit the web at low web speed. In order to minimize the contact time between the two incompatible fluids, the web speed was increased and the pump for the topcoat was started only after the base layer coating reached steady state. The pump settings for both fluids were adjusted so that a better coating was obtained.

After time, so-called "ice cap" formation was observed on the die. This "ice cap" formed where the two incompatible fluids first came into contact. The "ice cap" built up with time, then it started to break down into pieces as time went on. The break-down of the ice cap led to streaks in the coating and was difficult to recover.

Example 2

Base Case, With Re-Wet. No Gelling (or Bubbles)

The topcoat and the basecoat had the same formulations as in Comparative Example 2 and were formulated as described therein. The basecoat was applied to the substrate and dried. In a subsequent process, the topcoat was applied as above except that the topcoat was applied after wetting the basecoat with water (the re-wetting solution). Excess re-wetting solution was removed with a metering device prior to applying the topcoat. This process enabled long coating runs without streaks. The result after drying was a defect-free coating.

Incompatible Chemistry Examples

The following Examples 3–4 describe the use of the re-wet solution where incompatible chemistries are used with each other.

Example 3

Image Waterfastness—pH Adjustment

The topcoat and basecoat had the same formulations as in Comparative Example 1 and were formulated as described therein. A chemically-modified re-wet solution comprising 1.52 parts by weight citric acid (Aldrich) in 100 parts deionized water was used to adjust the pH of the coatings in the re-wetting step.

Waterfastness was measured by the following procedure (after the coatings were printed on an HP CP2500 printer using UV-pigmented inks):

1. Drop 250 μl of DI water on an ink-receiving coating by utilizing a micro pipette.
2. Use index finger to rub the coating area containing the 250 μl of DI water for 1 minute.
3. Wipe the excess water with a paper towel.
4. Use a heat gun to dry the wet area for 30 seconds.
5. Observe how much colorant smeared outside the colored area due to rubbing.

Following the above procedure, the ink-receiving coating was able to achieve good image waterfastness with pigment ink after 2 hours delay time, whereas significant color smearing was observed after testing the waterfastness of the coating prepared in Example 1.

Comparative Example 3

If citric acid is added to either the basecoat or topcoat, the coating fluid gels into a non-flocculated gel.

Example 4

Water Resistance of Coating—Crosslinker Addition

The topcoat, the re-wet solution, and the basecoat had the following formulations and were coated as in Examples 1 or 2.

| Chemicals | Manufacturer | Grade | Parts by Weight |
|---|---|---|---|
| | | Topcoat: | |
| polyvinyl alcohol | Aldrich | Airvol 165 | 100 |
| polyurethane | Dainippon Ink & Chemicals | IJ-60 | 25 |

| Chemicals | Manufacturer | Grade | Parts by Weight |
|---|---|---|---|
| | | Re-wet solution: | |
| DI-$H_2O$ | | | 100 |
| polyethyleneimine | Aldrich | MW 800 | 1 |

| Chemicals | Manufacturer | Grade | Parts |
|---|---|---|---|
| | | Basecoat: | |
| silica | Grace Davison | 0.2 μm porous | 100 |
| polyvinyl alcohol | Air Products | Airvol 350 | 26 |
| styrene-butadiene latex | Dow | XUR 1540 2494-6 | 5 |

The test method for measuring water resistance was identical to that described in Example 3 above, except that after Step 4, the test was performed on an unimaged coating and there was an additional step as follows:

5. Measure 20 degree gloss on both rubbed and unrubbed areas and compare the results.

In one series of experiments, samples were treated only with the basecoat and the topcoat solutions, using water as a re-wet fluid. In another series of experiments, the samples were also treated with the re-wet solution after application of the basecoat and before application of the topcoat.

In still another series of experiments, the polyethyleneimine was added directly to the basecoat solution or the topcoat solution.

For samples that were not treated with the re-wet solution, the measuring gloss number decreased from 63% at 20 degrees to 13% at 20 degrees. For samples that were treated with the chemically-modified re-wet solution in accordance with the present invention, the reading was 52 to 55% at 20 degrees, indicating improved water resistance of the coating. In the samples where the polyethyleneimine was added directly to the basecoat or topcoat solution, the solutions gelled and were un-coatable.

The results show that the chemical property such as water resistance of the ink-receiving coating is significantly improved by employing the re-wet process of the present invention, incorporating appropriate chemicals in the re-wet solution.

Example 5

Re-Wet Uptake

The basecoat of Example 4 was applied to a clear mylar film (Melinex, DuPont). Pore saturation time was measured by applying a 20 μl drop to the basecoat and measuring the time until the basecoat became transparent and unchanging, which indicated full pore saturation. The following re-wet solutions were tested, with the saturation time as indicated:

| Re-Wet Solution | Saturation Time, sec. |
|---|---|
| Water | 25 |
| 1% tetrahydrofuran (Aldrich) in water | 15 |
| 1% polyvinylalcohol (Aldrich) in water | 15 |

These examples demonstrate the increase in re-wet solution absorption rate upon modification of the re-wet solution.

Industrial Applicability

The topcoating process of the present invention is expected to find use in providing ink-receiving coatings on non-absorbent substrates.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. An improved process for applying at least one ink-receiving layer to a non-permeable substrate, said process comprising:

(a) applying a porous basecoat to a surface of said non-permeable substrate, said porous basecoat comprising a plurality of pores;

(b) applying a topcoat on said porous basecoat, the improvement comprising (1) directly forming said basecoat on said substrate surface;

(2) drying said basecoat, followed by applying a re-wet liquid directly to said porous basecoat to form a wetted basecoat, prior to applying said topcoat thereon, to thereby saturate said pores sufficient to prevent any air bubbles from forming in said topcoat; and (3) directly forming said topcoat on said wetted basecoat followed by drying said topcoat, to form said topcoat so as to be substantially free of irregularities or defects wherein said improved process produces a substantially uniform and bubble-free topcoat and is performed without cast-coating or lamination.

2. The process of claim 1 wherein said basecoat comprises at least one pigment and at least one binder.

3. The process of claim 1 wherein said topcoat comprises at least one pigment and at least one binder.

4. The process of claim 1 wherein said topcoat contains at least one solvent.

5. The process of claim 4 wherein said re-wet liquid contains at least one solvent.

6. The process of claim 1 wherein said re-wet liquid is heated to a temperature below its boiling point.

7. The process of claim 1 wherein said re-wet liquid modifies at least one property of at least one of said basecoat and said topcoat.

8. The process of claim 7 wherein said re-wet liquid is chemically modified by the addition of at least member selected from the group consisting of (1) at least one surfactant, (2) at least one pH modifier, (3) at least one polymer, (4) at least one crosslinker, (5) at least one pigment, and (6) at least one dye stabilizer, said at least one crosslinker operatively associated with at least one binder of either said basecoat, said topcoat, or both.

9. The process of claim 1 wherein an excess of said re-wet liquid is applied to said porous basecoat to ensure saturation or near-saturation of said pores.

10. The process of claim 9 wherein said excess re-wet liquid is removed prior to applying said topcoat.

11. The process of claim 1 wherein said basecoat and said topcoat each contain at least one pigment independently selected from the group consisting of silica, alumina, hydrates of alumina, titania, carbonates, glass beads, and organic pigments selected from the group consisting of cross-linked SBR latexes, micronized polyethylene wax, micronized polypropylene wax, acrylic beads, and methacrylic beads.

12. The process of claim 1 wherein said basecoat and said topcoat each contain at least one binder, wherein said re-wet liquid includes water, and wherein said at least one binder of said basecoat and said at least one binder of said topcoat are independently selected from the group consisting of polyvinyl alcohol and its derivatives, polyvinyl pyrrolidone/polyvinyl acetate copolymer, cellulose derivatives, styrene-butadiene latexes, acrylics, and polyurethanes.

13. Product produced by the process of claim 1.

14. A process for applying at least one substantially uniform and bubble-free ink-receiving layer to a non-permeable substrate without cast-coating or laminating, said process comprising:

(a) directly forming a porous basecoat on a surface of said non-permeable substrate, said porous basecoat comprising at least one pigment and at least one binder and further comprising a plurality of pores;

(b) drying said porous basecoat;

(c) applying an excess of a re-wet liquid directly to said porous basecoat, prior to applying a topcoat thereon, to form a liquid-coated basecoat and to ensure saturation of said pores, to thereby saturate said pores sufficient to prevent any air bubbles from forming in said topcoat;

(d) removing said excess; and (e) directly forming said topcoat on said liquid-coated basecoat, said topcoat comprising at least one pigment and at least one binder; and (f) drying said topcoat to form said topcoat so as to be substantially free of irregularities or defects.

15. The process of claim 14 wherein said topcoat as applied on said liquid-coated basecoat contains at least one solvent.

16. The process of claim 15 wherein said re-wet liquid contains at least one solvent.

17. The process of claim 14 wherein said re-wet liquid is heated to a temperature below its boiling point.

18. The process of claim 14 wherein said re-wet liquid modifies at least one property of at least one of said basecoat and said topcoat.

19. The process of claim 18 wherein said re-wet liquid is chemically modified by the addition of at least member selected from the group consisting of (1) at least one surfactant, (2) at least one pH modifier, (3) at least one polymer, (4) at least one crosslinker, (5) at least one pigment, and (6) at least one dye stabilizer, said at least one crosslinker operatively associated with at least one binder of either said basecoat, said topcoat, or both.

20. The process of claim 14 wherein said pigment for said basecoat and said pigment for said topcoat are each independently selected from the group consisting of silica, alumina, hydrates of alumina, titania, carbonates, glass beads, and organic pigments selected from the group consisting of cross-linked SBR latexes, micronized polyethylene wax, micronized polypropylene wax, acrylic beads, and methacrylic beads.

21. The process of claim 14 wherein said re-wet liquid contains water and said at least one binder of said basecoat and said at least one binder of said topcoat are independently selected from the group consisting of polyvinyl alcohol and its derivatives, polyvinyl pyrrolidone/polyvinyl acetate copolymer, cellulose derivatives, styrene-butadiene latexes, acrylics, and polyurethanes.

22. Product produced by the process of claim 14.

* * * * *

UNITED STATES PATENT AND TRADEMARK OFFICE

CERTIFICATE OF CORRECTION

PATENT NO. : 6,475,612 B1
DATED : November 5, 2002
INVENTOR(S) : Knight et al.

It is certified that error appears in the above-identified patent and that said Letters Patent is hereby corrected as shown below:

Column 8,
Line 12, delete "basecoat."
Line 13, delete "and said topcoat." and insert therefor -- basecoat, said topcoat, said improved process, and performance of said basecoat or said topcoat. --
Line 64, delete "defects." and insert therefor -- defects including cracks --.

Column 9,
Line 6, delete "basecoat".
Line 7, delete "and said topcoat." and insert therefore -- basecoat, said topcoat, said improved process, and performance of said basecoat or said topcoat. --

Signed and Sealed this

Twenty-seventh Day of January, 2004

JON W. DUDAS
*Acting Director of the United States Patent and Trademark Office*